US006652333B1

(12) United States Patent
Adomeit

(10) Patent No.: US 6,652,333 B1
(45) Date of Patent: Nov. 25, 2003

(54) JET BOAT STEERING SYSTEM

(76) Inventor: Mark E. Adomeit, 779 Phoenix Rd., South Haven, MI (US) 49090

( * ) Notice: Subject to any disclaimer, the term of this patent is extended or adjusted under 35 U.S.C. 154(b) by 0 days.

(21) Appl. No.: 09/793,875

(22) Filed: Feb. 28, 2001

(51) Int. Cl.[7] ..... B63H 11/117
(52) U.S. Cl. ..... 440/43
(58) Field of Search ..... 441/40–43; 114/144 R; 440/38

(56) References Cited

U.S. PATENT DOCUMENTS 5,167,547 A * 12/1992 Kobayashi et al. ..... 440/42
6,086,437 A * 7/2000 Murray ..... 440/43

* cited by examiner

*Primary Examiner*—Ed Swinehart
(74) *Attorney, Agent, or Firm*—Alex Rhodes

(57) ABSTRACT

A steering system for steering a personal water craft when a high velocity water jet which is used for propelling and steering said water craft is cut off by an engine failure. In a first embodiment, a rudder is pivotally mounted on a nozzle for rotation about a horizontal axis between an elevated non-operative position and a lowered operative position. In a first embodiment, the rudder is automatically raised to the non-operative position by an impingement of the water jet on a baffle on the rudder. When an engine failure occurs, the rudder is automatically lowered to the operative position by hydrodynamic and gravitational forces which act on the rudder. In the operative position, braking forces are generated by a fin on the rudder. In a second embodiment, the rudder is manually elevated to a non-operative position and manually lowered to an operative position by a link or a cable.

15 Claims, 5 Drawing Sheets

JET BOAT STEERING SYSTEM

FIELD OF THE INVENTION

This invention relates to water craft and more particularly to an emergency steering system for a jet propelled water craft.

BACKGROUND OF THE INVENTION

Jet propelled personal water craft (PWC) have become increasingly popular during recent years. They are shallow draft boats and skis which are propelled by the impulse of high velocity water jets. The water jets are discharged through nozzles, mounted at the rear of boats. They are steered by rotating the nozzles about vertical axes with linkages or cables. The rotation of the nozzles changes the direction of the water jets causing the boats to change their courses. They are generally operated within the confines of small inland lakes.

The high speeds and maneuverability of PWC are the reasons for their popularity with water sportsmen. During 1997, approximately 200,000 PWC were sold in the U.S.A. The sales constituted more than one-third of new recreational boat sales. About 1 million are in current use and their numbers are growing.

Injuries and casualties are major problems with PWC. The National Transportation Safety Board is concerned about the safety of PWC and is searching for solutions. A major cause of the safety problems is that steering is lost when an engine fails. The loss of steering in a PWC is particularly serious because of the high speeds and the manner in which PWC are operated within the confines of the small lakes. A loss of steering can result in a grounding of a PWC or a collision with a swimmer or other water craft.

SUMMARY OF THE INVENTION

The present invention is a complete solution to the problem of the loss of steering when an engine fails. The solution resides in novel features which individually and collectively contribute to the ability of the invention to steer a PWC when an engine fails. An important benefit of the invention is that existing PWC can be easily and economically retrofitted with the invention. An important feature of the invention is that a substitute steering system is automatically activated when an engine fails. Another benefit is that the substitute steering system becomes immediately effective when an engine fails. A still further feature is that braking forces are generated when the substitute steering system is activated.

In a first embodiment of the invention, a rudder is pivotally mounted on a nozzle of a PWC for rotation about a horizontal axis. When the PWC's engine is started, the rudder is elevated to a non-operative position by an impingement of a water jet on a baffle which is substantially in covering relationship with an outlet of the nozzle. If an engine fails, the rudder is automatically lowered to an operative position by gravitational and hydrodynamic forces. At the operative position, braking forces are generated by a fin on the rudder. When the engine is re-started, the rudder is automatically raised by the water jet to the elevated non-operative position.

In a second embodiment of the invention, one end of a cable or link is attached to a rudder and an opposite end of the cable or link is attached to a usual type of manual control. If the water jet is cutoff because of an engine failure, The rudder is manually elevated and lowered by a PWC operator to the non-operative and operative positions.

In employing the teachings of the present invention, a plurality of alternate constructions can be adopted to achieve the desired results and capabilities. In this disclosure, only several aspects of the invention are discussed. However, these aspects are intended as examples and should not be considered as limiting the scope of the invention.

Further objects, benefits and features of the invention will become apparent from the ensuing detailed description and drawings which illustrate and describe the invention. The best mode which is contemplated in practicing the invention together with a preferred manner of using the invention are disclosed and the property in which exclusive rights are claimed is set forth in each of a series of numbered claims at the conclusion of the detailed description:

BRIEF DESCRIPTION OF THE DRAWINGS

The invention will be better understood and further objects, characterizing features, details and advantages thereof will appear more clearly with reference to the diagrammatic drawing illustrating a presently preferred specific embodiment of the invention by way of non-limiting example only.

DETAILED DESCRIPTION OF A PREFERRED EMBODIMENT

Figure 1:
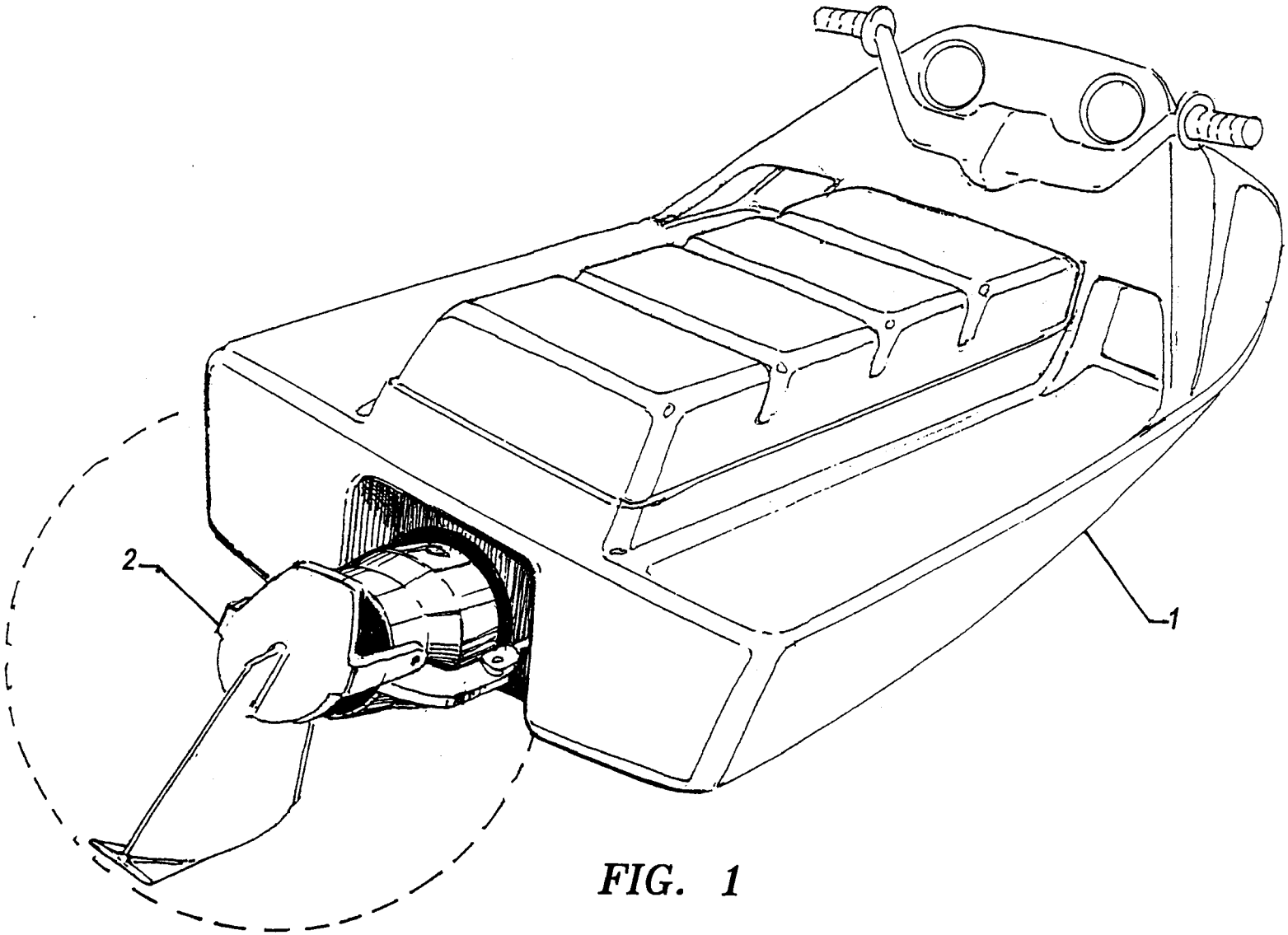
FIG. 1 is a perspective view of a jet boat with an auxiliary steering system according to the present invention.

Referring now to the drawings wherein like numerals designate like and corresponding parts throughout the several views, a PWC 1 is shown in FIGS. 1 through 5, inclusive, with a steering system according to the present invention 2. The style of the PWC 1 is arbitrary and is not intended to limit the scope of the invention, since PWC's are available in a variety of shapes.

Figure 3:
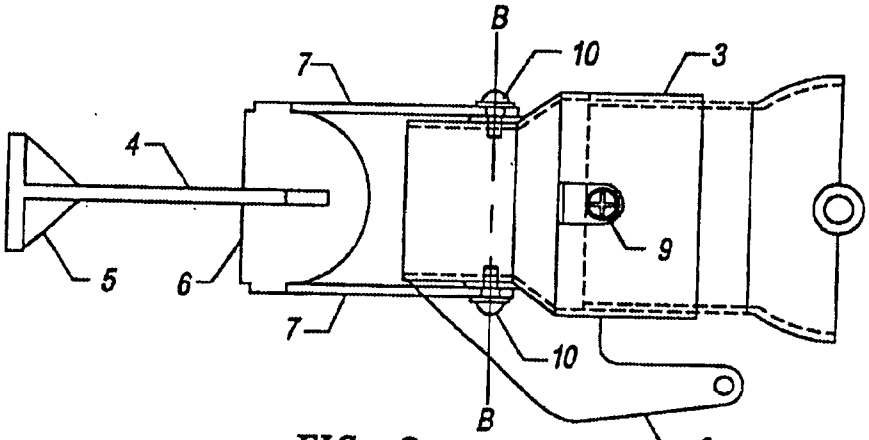
FIG. 3 is a plan view of the auxiliary steering system in an operative position.
Figure 4:
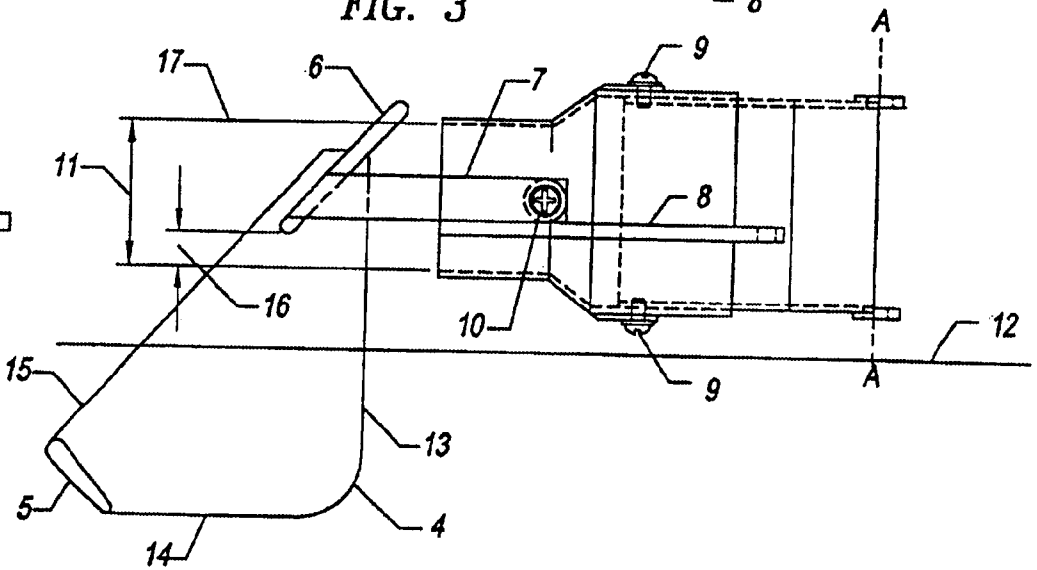
FIG. 4 is a right side view of the auxiliary steering system in the operative position.
Figure 5:
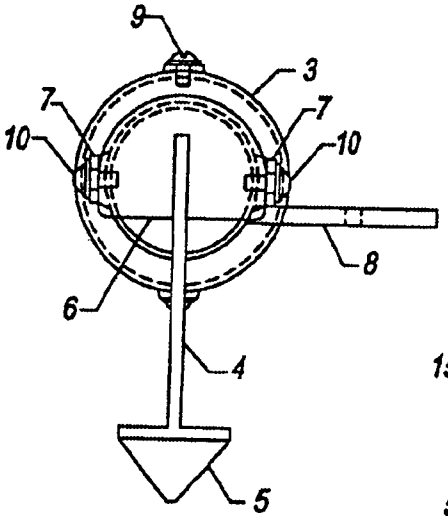
FIG. 5 is a rear view of the auxiliary steering system in the operative position.

The invention is best understood by reference to FIGS. 3 and 4. A nozzle 3 is mounted at the center and rear of the PWC is with a pair of threaded fasteners 9. The nozzle 3 is rotatable about a vertical axis A—A. The PWC 1 is propelled through the water by the impulse of a high velocity water jet 11 which is discharged from the nozzle 3, a small distance above the a body of water 12. During the normal operation of the PWC 1, the PWC 1 is steered by rotating the nozzle 3 with a linkage or cable about the vertical axis A—A. The linkage or cable is connected to a steering arm 8 at the side of the nozzle 3. The linkage or cable, rotates the nozzle 3 clockwise or counterclockwise about the vertical axis A—A.

One feature of the invention is a triangular shaped rudder 4 which is pivotally attached to the nozzle 3 with shoulder bolts 10 and a yoke shaped arrangement of a pair of forwardly extending arms 7. The rudder 4 is rotatable about a horizontal axis B—B, from the lower operative position, shown in FIGS. 1 through 5 to the upper non-operative position, shown in FIG. 6. In order to minimize the influence of the rudder 4 on the performance of PWC 1 it is desirable that the rudder 4 is as small as possible.

To meeting this end, a triangular shaped rudder 4 is provided which resembles a 45 degree right triangle. The rudder has a vertical front edge 13, a horizontal lower edge 14 and an inclined rear edge 15. Although other shapes can be used, the triangular shape provides two benefits. One benefit is that the centroid of the rudder's area lies substantially rearward of the nozzle's vertical pivot axis A—A. The rearward positioning of the centroid increases the steering effectiveness of the rudder 4 over other shapes. The other benefit is that the center of gravity of the rudder 4 lies substantially rearward of the rudder's horizontal pivot axis B—B. The rearward positioning of the center of gravity, reduces the need for a ballast weight at the end of the rudder for lowering the rudder 4 if an engine fails. However, It should be appreciated than ballast weights may be used for lowering the rudder.

At the upper end portion of the rudder there is a baffle 6 for elevating the rudder 4 to the non-operative position. Referring to FIG. 4, when the rudder 4 is at the operative position, the baffle 6 is inclined at about a 45 degree angle and is in substantial covering relationship with an outlet of the nozzle 4 and the arms 7 rest on the steering arm 8 of the nozzle 3. The rudder 4 is positioned such that in the operative position of the rudder 4 the distance 16 between the lowermost edge of the baffle 4 to the lower edge of the water jet 11 is about one quarter of the diameter of the water jet 11. This spacing is to prevent the stalling of an engine during start-up when the engine rpm and power are low.

Figure 6:
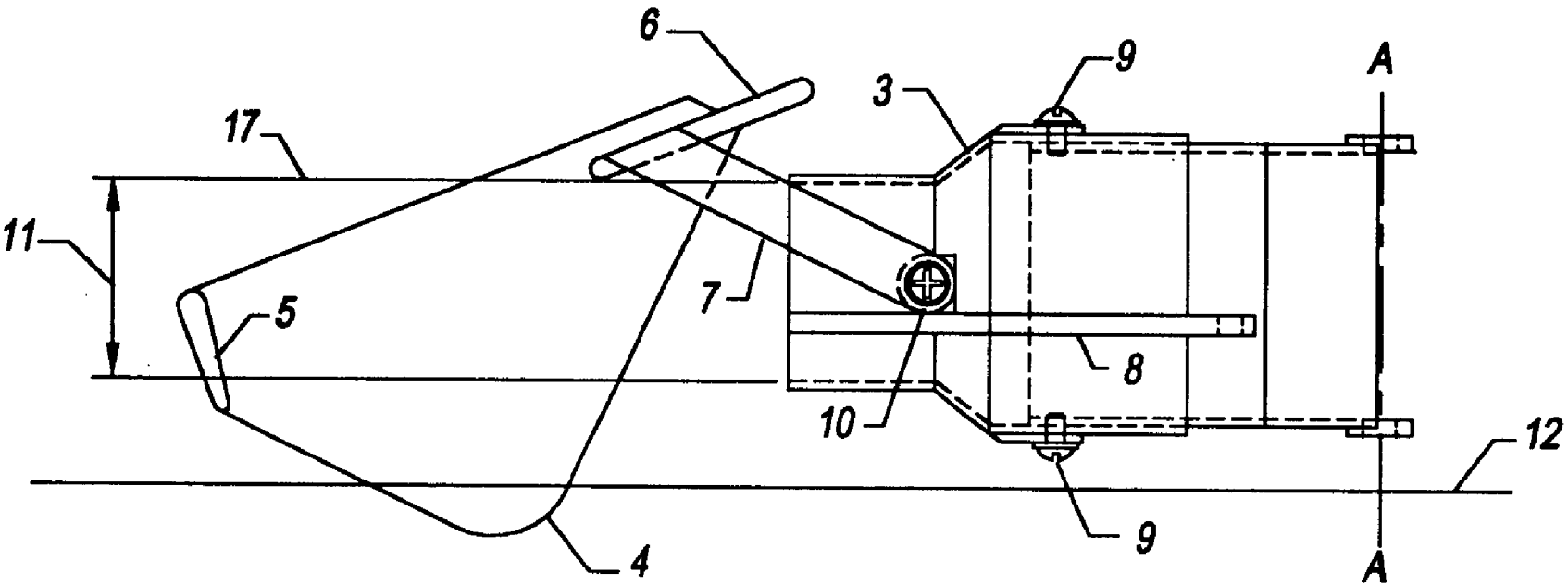
FIG. 6 is a right side view of the auxiliary steering system in a non-operative position.

When the engine is started, the water jet 11 impinges on the baffle 6, elevating the rudder 4 to the non-operative position shown in FIG. 6. At this position, the lower edge of the battle 6 is aligned with the upper edge 17 of the water jet 11. So long as the engine continues to operate, the baffle 6 will maintain the rudder 4 in the non-operative position. If the engine fails, the water jet will stop and the rudder 4 will rotate downwardly by hydrodynamic and gravitational forces to the operative position shown in FIGS. 1 through 5.

Figure 2:
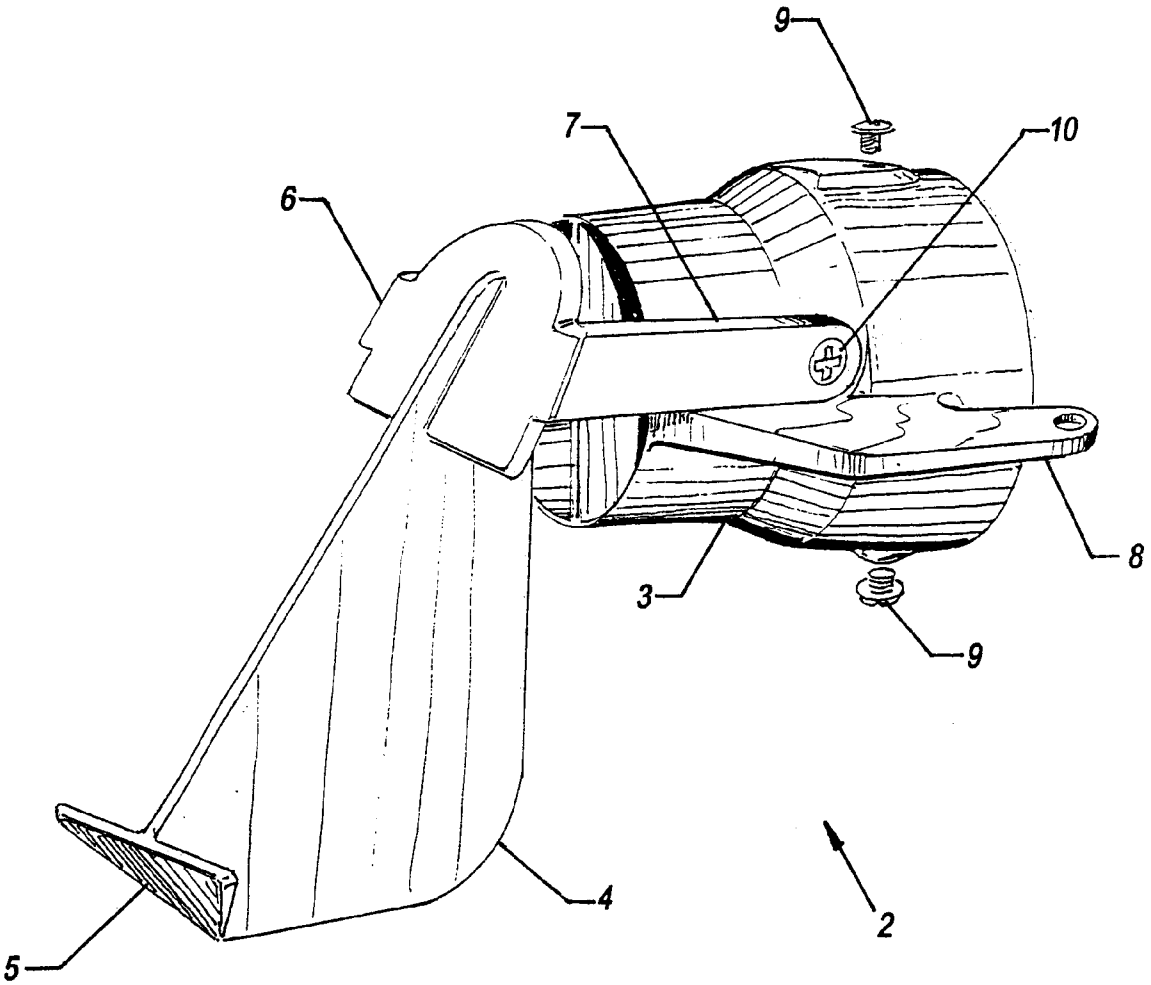
FIG. 2 is an enlarged perspective view of the auxiliary steering system.

Referring now to FIG. 2, another important feature of the invention is a triangular fin 5, at the truncated comer of the rudder 4 where the inclined edge 15 approaches the horizontal edge 14. When the rudder 4 is at its operative position, braking forces are generated by the triangular fin 5 which assist an operator in controlling the PWC.

In summary, the invention is used in the following manner. When the PWC 1 is idle, the baffle 6 is in substantial covering relationship with the outlet of the nozzle 3. When the engine of the PWC 1 is started, a high velocity water jet 11 impinges on the baffle 6, raising the rudder 4 to the non-operative position shown in FIG. 6. The rudder 4 remains at the elevated non-operative position during normal conditions by the water jet 11. If the water jet 11 is cut off by an engine failure, gravitational and hydrodynamic forces acting on the rudder, cause the rudder 4 to rotate about the horizontal axis B—B to the operative position, allowing a boat operator to steer his PWC by rotating the rudder 4 which is attached to the rudder 4 about the axis A—A.

It will be appreciated that the automatic lowering of the rudder 4 forestall mishaps due to the panic of some boat operators. It will also be appreciated that the automatic lowering of the rudder 4 immediately brings into play the braking forces of the triangular fin 7.

Figure 7:
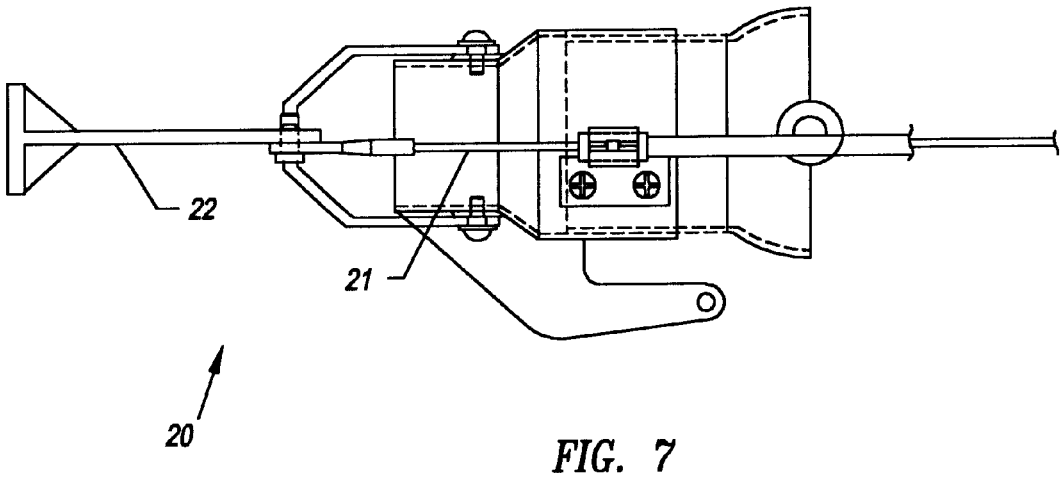
FIG. 7 is a plan view of an alternate embodiment of the invention.
Figure 8:
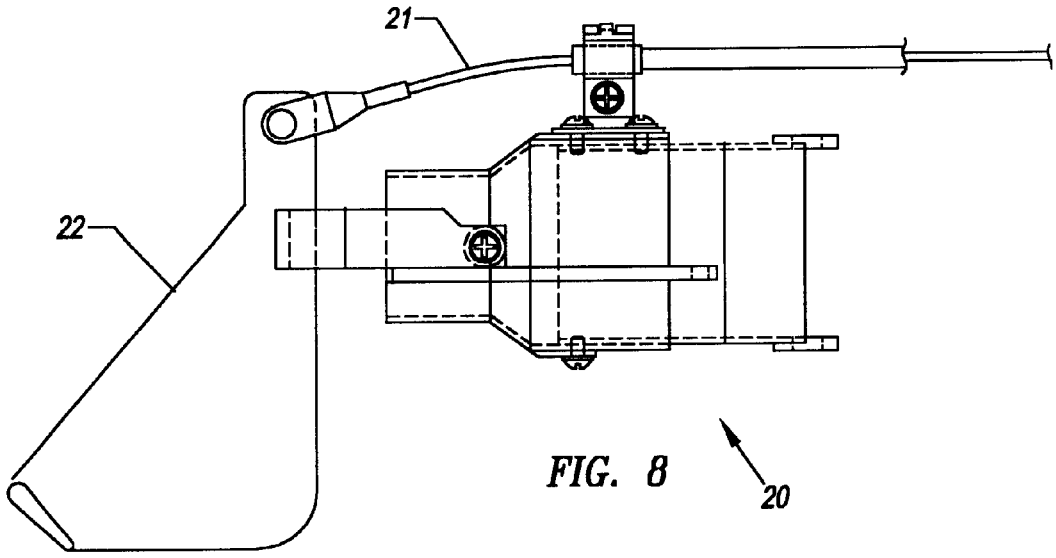
FIG. 8 is a right side view of the alternate embodiment in an operative position.

In the alternate embodiment 20 of FIGS. 7 and 8, a less effective means is used for raising and lowering a rudder 22. The rudder 22 is raised and lowered with a push-pull cable 21 having one end portion attached to an upper portion of the pivotally mounted rudder 22 and at an opposite end portion to a usual manual control (not shown). Since an action of a boat operator is required to raise and lower the rudder 22, it will be understood that this embodiment has an obvious disadvantage over the first embodiment.

From the above, it is apparent that my invention is a total solution to the problem of lost steering in a PWC because of an engine failure. Moreover, my invention provides the important advantages of simplicity, moderate cost, automatic operation, emergency braking, and adaptability to current PWC. Most importantly, it will reduce injuries and fatalities relating to PWC.

Although only two embodiments of my invention have been illustrated and described, it is obvious that other embodiments can be developed by obvious changes in shape, number of parts, inversions of parts, substitutions of materials, and substitutions of parts without departing from the spirit thereof.

What I claim is new is:

1. A steering system for steering a PWC during a forward movement of said PWC when a high velocity water jet of said water craft is cut-off, said steering system comprising a rudder, said rudder being automatically movable to an elevated non-operative rudder position by said water jet during a normal operation of said water craft and automatically movable by gravity without assistance to a lowered operative rudder position when said water jet is cut off during a forward movement of said PWC, said rudder mounted on a rear of said water craft for rotation about a horizontal axis from said lowered operative rudder state to said elevated non-operative state by an impingement of said water jet on a baffle of said rudder and having a mass which, in itself with hydrodynamic forces, is sufficient for overcoming a hydraulic drag of said rudder to rotate said rudder downwardly about said horizontal axis when said water jet is cut-off; a means for mounting said rudder; and a means for rotating said rudder about a vertical axis during said operative state.

2. The steering system recited in claim 1 wherein said rudder resembles a right angle triangle, said rudder having a vertical front edge, a horizontal lower edge and an inclined rear edge.

3. The steering system recited in claim 1 wherein said means for mounting said rudder on said water craft is a yoke shaped arrangement of a pair of forward extending arms and a pair of shoulder bolts for attaching said arms to opposite side portions of said nozzle.

4. The steering system recited in claim 1 further comprising a fin on said rudder for providing a braking force during said downward rotation to said lower operative state.

5. In combination with a PWC of the type wherein said PWC is steered during normal service by a high velocity water jet a steering system for steering said PWC when said high velocity water jet is cut off during a forward movement of said PWC, said steering system comprised of: a rudder mounted on the rear of said water craft for steering said water craft during said forward movement when said water jet is cut-off, said rudder having a mass which is by itself is sufficient to overcome a hydraulic drag of said rudder and rotate said rudder downwardly by gravity from an elevated non-operative rudder state to a lowered operative state when said water jet is cut off during said forward movement of said PWC; a means for mounting said rudder on said PWC for rotation about said horizontal axis; and a means for rotating said rudder about a vertical axis.

6. The combination set forth in claim 5 further comprising a means for generating braking forces during said downward rotation of said rudder to said operative state.

7. The improvement set forth in claim 5 wherein said means for rotating said rudder about said horizontal axis when said water jet is not cut off is a baffle for intercepting said water jet to rotate said rudder to said elevated non-operative position.

8. The improvement set forth in claim 5 wherein said means for mounting said rudder for rotation about said horizontal axis is a yoke arrangement of pair of forward extending arms and a pair of shoulder bolts for attaching said arms to opposite sides of said nozzle.

9. A method for controlling a forward movement of a PWC after cut off of a high velocity water jet which is used for propelling and steering said PWC, said method comprised of the steps of: using a mass of a rudder which, in itself with hydrodynamic forces, is sufficient to automatically overcome a hydraulic drag of said rudder and rotate said rudder downwardly about a horizontal axis by gravity from an elevated non-operative position to a lower operative position; and manually rotating said rudder in said lower operative rudder position about a vertical axis to steer said PWC.

10. The method recited in claim 9 further comprising the step of braking said PWC with a fin mounted on said rudder during said downward rotation of said rudder when said water jet is cut off.

11. A steering system for steering a PWC after a high velocity water jet of said water craft is cut-off, said steering system comprising: a rudder mounted on the rear of said water craft for rotation about a horizontal axis, said rudder having a mass which, in itself with hydrodynamic forces, is sufficient to rotate said rudder downwardly and overcome a hydraulic drag of said rudder when said water jet is cut-off to a lowered operative rudder position; a baffle on said upper end portion of said rudder to intercept said water jet for rotating said rudder from said lowered operative rudder position to said elevated non-operative rudder position when said water jet is turned on; and a means for mounting said rudder to said water craft.

12. The steering system recited in claim 11 wherein said rudder has a vertical front edge, a horizontal lower edge and an inclined rear edge.

13. A steering system for steering a PWC after a high velocity water jet of said water craft is cut-off, said steering system comprising: a rudder mounted on the rear of said water craft for rotation about a horizontal axis, said rudder having a transverse baffle for raising said rudder to a non-operative position by impinging said baffle with said water jet and having a mass which, in itself with hydrodynamic forces, is sufficient to overcome a hydraulic drag of said rudder and automatically rotate said rudder downwardly when said water jet is cut off to a lowered operative position; and a means on said rudder for generating braking forces when said during said lowering of said rudder to its lowered operative position.

14. A steering system for steering a PWC after a high velocity water jet of said water craft is cut-off, said steering system comprising: a rudder, said rudder being automatically movable to a raised nonoperative position during a normal operation of said water craft by the discharge of a water jet from a nozzle mounted on a rear of said water craft and an operative position when said water jet is cut off, said rudder mounted for rotation about a horizontal axis and having a mass which is sufficient, in itself with hydrodynamic forces, to overcome a hydraulic drag of said rudder and rotate said rudder downwardly to said operative position when said water jet is cut-off; a yoke shaped arrangement of a pair of forward extending arms and a pair of shoulder bolts for attaching said arms to opposite side portions of said nozzle; and a means for rotating said rudder about a vertical axis during said operative state.

15. A steering system for steering a PWC after a high velocity water jet of said water craft is cut-off, said steering system comprising: a triangular shaped rudder, said rudder being automatically rotatable upwardly to a non-operative position during a normal operation of said water craft and said water craft is propelled and steered by the discharge of a water jet from a nozzle mounted on a rear of said water craft and being automatically rotatable downwardly to an operative position when said water jet is cut off, said rudder having a mass which, in itself with hydrodynamic forces, is sufficient to overcome a hydraulic drag of said rudder and rotate said rudder downwardly position by gravity to said operative position when said water jet is cut-off; a means for mounting said rudder; a means for rotating said rudder about a vertical axis during said operative state; and a transverse triangular fin on a lower rear comer of said rudder for providing a braking force when said rudder is being rotated to said lower operative state.

* * * * *